United States Patent [19]

Chatourel

[11] Patent Number: 5,016,757

[45] Date of Patent: May 21, 1991

[54] OPENING-CLOSING DEVICE FOR A BAG OF FLEXIBLE SYNTHETIC MATERIAL WITH LIMITED PENETRATION

[75] Inventor: Daniel Chatourel, Vittel, France

[73] Assignee: Societe Generele des Eaux Minerals de Vittel, Vittel, France

[21] Appl. No.: 370,387

[22] Filed: Jun. 22, 1989

[30] Foreign Application Priority Data

Jun. 22, 1988 [FR] France ..... 88 08568

[51] Int. Cl.[5] ..... B65D 33/16

[52] U.S. Cl. ..... 206/603; 222/83.5; 222/90; 383/66; 383/80

[58] Field of Search ..... 222/83, 83.5, 90, 107; 383/66, 80; 206/603

[56] References Cited

U.S. PATENT DOCUMENTS

| | | | |
|---|---|---|---|
| 3,081,911 | 3/1963 | Scholle | 222/107 |
| 3,783,920 | 1/1974 | Weikert | 383/90 |
| 4,017,020 | 4/1977 | Frank | 383/66 |
| 4,257,535 | 3/1981 | Mellett | 222/83 |
| 4,325,496 | 4/1982 | Malpas | 222/83 |
| 4,440,316 | 4/1984 | Christine | 222/83.5 |
| 4,493,438 | 1/1985 | Rutter | 222/83 |
| 4,516,691 | 5/1985 | Christine et al. | 222/83.5 |
| 4,567,999 | 2/1986 | Hjertman et al. | 222/83 |
| 4,602,725 | 7/1986 | Malpas et al. | 222/83.5 |
| 4,798,605 | 1/1989 | Steiner et al. | 222/83 |

*Primary Examiner*—Stephen P. Garbe

*Attorney, Agent, or Firm*—Weiser & Stapler

[57] ABSTRACT

Opening-closing device for a bag of flexible synthetic material obtained from a material in the form of a film, of the type comprising a threaded drum which is attached to a wall of the said bag and interacts with a stopper capable of being screwed onto the said drum and comprising teeth making it possible to cut out the wall in the region of the central orifice of the drum to permit the opening of the said bag, characterized in that it comprises a means which is integral with the drum (2) and/or the stopper (1) and makes it possible to protect the opposite wall of the bag against the teeth (5) of the said stopper.

According to an alternative form, the shoulder (7) of the drum (2) comprises a substantially cylindrical collar (8) dimensioned in such a way that the ends of the teeth cannot exceed its edge (9).

10 Claims, 1 Drawing Sheet

FIG. 1
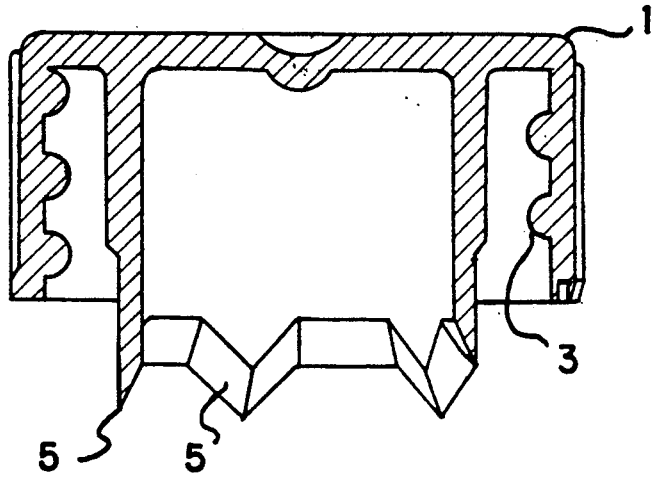
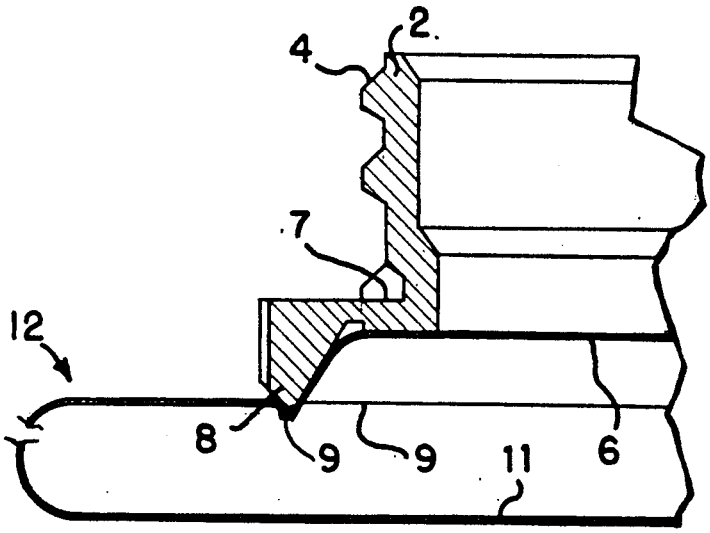
FIG. 2
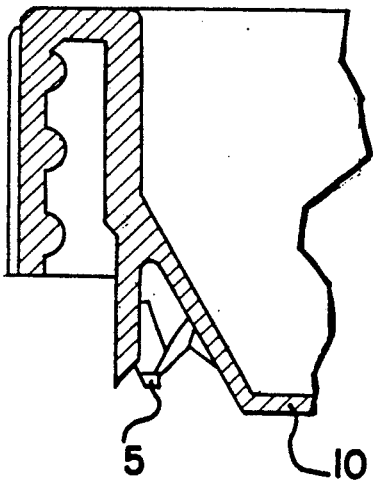
FIG. 3

OPENING-CLOSING DEVICE FOR A BAG OF FLEXIBLE SYNTHETIC MATERIAL WITH LIMITED PENETRATION

The present invention relates to an opening-closing device for a bag of flexible synthetic material obtained from a material in the form of a film, of the type comprising a threaded drum which is attached to a wall of the said bag and interacts with a stopper capable of being screwed onto the said drum and comprising teeth making it possible to cut out the wall in the region of the central orifice of the drum to permit the opening of the said bag.

Devices of this type are known per se, as are the bags in question.

They formed the subject, for example, of Patent U.S. Pat. No. 4,440,316 and also of French Patent Applications 85 13204 and 86 09702 in the name of the applicant.

The flexible bags in question formed the subject, this being non-limiting, for example, of French Patent Application 83 18257, also in the name of the applicant.

In the case of bags equipped with an opening-closing device of the type described above, there is a risk, with careless handling, of the teeth of the stopper piercing the opposite wall, which makes the bag unusable subsequently.

The present invention proposes to overcome these disadvantages of the prior art.

In accordance with the invention, this result is obtained with an opening-closing device for a bag of flexible synthetic material obtained from a material in the form of a film, of the type comprising a threaded drum which is attached to a wall of the said bag and interacts with a stopper capable of being screwed on to the said drum and comprising teeth making it possible to cut out the wall in the region of the central orifice of the drum to permit the opening of the said bag, characterized in that it comprises a means which is integral with the drum and/or the stopper and makes it possible to protect the opposite wall of the bag against the teeth of the said stopper.

According to an alternative embodiment, the shoulder of the drum will comprise a cylindrical collar, on the same axis as the drum and the stopper, the edge of which will be arranged in depth beyond the furthest position which can be attained by the teeth in the position of maximum screwing.

According to a further alternative embodiment, the stopper will comprise a central boss projecting with respect to the ends of the teeth.

The invention will be better understood with the aid of the description below which is given with reference to the attached drawings, in which:

FIG. 1 is a view in longitudinal section of a stopper used in a device according to the invention;

FIG. 2 is a view in longitudinal half-section of the drum of a device according to the invention;

FIG. 3 is a view in longitudinal half-section of an alternative form of a stopper for a device according to the invention.

Reference will be made firstly to FIGS. 1 and 2.

The device comprises a stopper (1) which is screwed onto a drum (2) by complementary threads (3, 4) with insertion, before first use, of a protective ring.

The drum (2) is disposed on the outer surface of the bag (12) in such a way that a region (6) on the outer surface of the bag is encompassed by the central orifice of the drum (2)

The stopper (1) comprises teeth (5) which during the screwing perforate the film in the region (6) of the central orifice of the drum.

To prevent the perforation of the opposite wall of the bag it is possible, as shown in FIG. 2, to provide the shoulder (7) of the drum with a substantially cylindrical collar (8) which is coaxial with the drum and the stopper. The collar (8) is dimensioned relative to the teeth (5) in the stopper (1) such that, when the stopper (1) is fully screwed onto the drum (2), the teeth (5) of the stopper (1) do not extend further into the bag than the edge (9) of the collar (8). In this way, the collar (8) protects other portions of the bag such as opposite wall (11) from being cut by the teeth (5) in the stopper (1). This collar can additionally serve as a gripping means for use during the screwing and the perforation.

In the alternative form of FIG. 3, the stopper comprises a boss (10) projecting with respect to the teeth (5).

It prevents any contact between the teeth and the opposite wall (11) which is schematically shown in FIG. 2.

Additionally, it makes possible the pretensioning of the film in region (6) before its perforation, and thus facilitates the latter.

I claim:

1. A bag of flexible synthetic film material having an opening-closing device attached to wall portions of the bag, the opening-closing device comprising a threaded neck portion attached to the wall portions of the bag, a stopper for threaded engagement with the neck portion and including teeth for engaging, cutting and opening said wall portions of the bag, and means for preventing contact between the teeth of the stopper and other wall portions of the bag remote from said wall portions having the opening-closing device attached thereto, to protect said other wall portions from being cut.

2. The bag of claim 1 wherein the neck portion includes a substantially cylindrical collar which is generally coaxial with the neck portion, said collar defining a shoulder for cooperating with the stopper so that ends of the teeth cannot extend beyond the collar.

3. The bag of claim 2 wherein end portions of the collar of the opening-closing device are attached to said wall portions of the bag, and wherein said ends of the teeth cannot extend into contact with said other wall portions of the bag.

4. The bag of claim 2 wherein the collar further includes a surface for gripping during opening and closing of the stopper.

5. The bag of claim 1 wherein the stopper includes a boss which projects beyond the teeth of the stopper.

6. The bag of claim 5 wherein the boss is positioned to engage said other wall portions before said teeth can come into contact with said other wall portions.

7. An opening-closing device for attachment to a bag of flexible synthetic film material, comprising a threaded neck portion for attachment to a wall of the bag, a stopper for threaded engagement with the neck portion, said stopper including teeth for engaging, cutting and opening wall portions of a bag attached to the opening-closing device, and means for limiting extension of the teeth of the stopper to prevent contact between the teeth of the stopper and other wall portions of the bag, to protect said other wall portions from being cut.

8. The opening-closing device of claim 7 wherein the neck portion includes a substantially cylindrical collar which is generally coaxial with the neck portion, said collar defining a shoulder for cooperating with the stopper so that ends of the teeth cannot extend beyond the collar.

9. The opening-closing device of claim 8 wherein the collar further includes a surface for gripping during opening and closing of the stopper.

10. The opening-closing device of claim 7 wherein the stopper includes a boss which projects beyond the teeth of the stopper.

* * * * *